United States Patent [19]

Shaddock

[11] Patent Number: 4,819,314

[45] Date of Patent: Apr. 11, 1989

[54] JET NOZZLES

[75] Inventor: Roland E. Shaddock, Streator, Ill.

[73] Assignee: The Pullman Peabody Company, Princeton, N.J.

[21] Appl. No.: 219,072

[22] Filed: Jul. 11, 1988

Related U.S. Application Data

[62] Division of Ser. No. 005,946, Jan. 22, 1987, Pat. No. 4,764,180.

[51] Int. Cl.[4] ..... B21D 53/24

[52] U.S. Cl. ..... 29/157 C; 29/157 R; 134/167 C; 239/DIG. 13

[58] Field of Search ..... 29/157 C, 107 R, DIG. 26, 29/DIG. 48; 239/DIG. 13; 134/167 C

[56] References Cited

U.S. PATENT DOCUMENTS

| | | | |
|---|---|---|---|
| 2,694,022 | 11/1954 | Schreiner | 134/24 |
| 2,735,794 | 2/1956 | Pletcher | 134/167 C X |
| 3,080,265 | 3/1963 | Maasberg | 134/24 |
| 3,149,784 | 9/1964 | Skidgel | 239/601 X |
| 3,246,660 | 4/1966 | Hammelmann | 134/167 C |
| 3,321,184 | 5/1967 | Goss | 254/134.4 |
| 3,658,589 | 4/1972 | Shaddock | 134/10 |
| 3,744,723 | 7/1973 | Davis | 239/DIG. 13 |
| 4,677,997 | 7/1987 | Strauss | 134/167 C |

OTHER PUBLICATIONS

Brochure Entitled "Pressure" by Adolf Ries, Bruchsal, Germany, dated 6/11/69.

*Primary Examiner*—Timothy V. Eley
*Assistant Examiner*—Frances Chin

[57] ABSTRACT

Self propelling jet nozzles especially suited for cleaning sewer pipes and the like are formed from a tubular body member and a nose cap by machining parallel inner and outer ledges or shoulders inboard from the leading end of the tubular member at a rearwardly inclined angle, drilling a ring of circumferentially spaced bores diverging outwardly from the inner to the outer ledges and tapered toward the outer ledge, securing wear resisting nozzle tubes in the bores in mated relation with the tapered portions thereof and welding the nose cap on the leading end of the tubular body. The trailing end of the body is threaded to receive a water conduit, the nozzle tubes in the bores discharge rearwardly and outwardly around the trailing end of the body to propel the nozzle forwardly. The nose can be provided with one or more passageways discharging forwardly and these passageways can also be provided with rear resisting tubular nozzle inserts. The joining ends of the tubular body and nose are tapered to provide a V groove with welding material filling the groove. The outer diameter portion of the tubular body rearwardly from the external ledge is machined to provide a conical neck extending rearwardly and radially outward from the radial inner end of the ledge. This neck conforms with the inclination of the bores so that the jet streams emerging from the nozzle tubes surround but do not impinge against the tubular body.

12 Claims, 2 Drawing Sheets

JET NOZZLES

This is a division of application Ser. No. 005,946, filed Jan. 22, 1987, now U.S. Pat. No. 4,764,180.

FIELD OF THE INVENTION

This invention relates to jet nozzles especially of the self-propelling type useful in sewer pipe cleaning apparatus and more specifically deals with machined body and nose components of jet nozzles to facilitate formation of jet passages which have inner ends larger than their outer ends and wedge lock wear resistant nozzle tubes therein.

BACKGROUND OF THE INVENTION

Self-propelling jet nozzles for sewer pipe cleaning apparatus are disclosed, for example, in the Roland E. Shaddock U.S. Pat. No. 3,658,589, issued Apr. 25, 1972. These prior known nozzles have one piece hollow heads with a ring of rearwardly opening circumferentially spaced nozzle holes of constant diameter throughout their length so that the propelling jet streams do not converge to increase in velocity as they pass through the holes and soon erode and enlarge the holes to decrease the propelling force of the jets.

It would therefore be an improvement in this art to provide self-propelled jet nozzles for sewer pipe cleaning and the like which have circumferentially spaced nozzle bores that have inner ends larger than outer ends and effective to wedge lock wear resistant nozzle tubes in the bores under the action of the high pressure streams of water flowing through the bores.

SUMMARY OF THE INVENTION

According to this invention there are provided manufacturing high pressure water jet nozzles which propel themselves through passageways such as sewer pipes and the like and wash debris from the passage. The nozzles have a thick wall rigid tubular member preferably composed of a noncorroding hard steel. This tubular body, for example, may be about 3" long, has an inner diameter of about 1", and an outer diameter of about 2". A leading end of the body is counterbored to about 1½" for a depth of about ½" while the trailing end is internally threaded to a depth of about 1¼". The counterbore provides an internal shoulder of about ¼" which is machined to form a ledge inclined rearwardly from the radius of the tube. The outer diameter of the tube is then machined to form an external ledge substantially parallel with the inner ledge and a conical neck portion diverging from the radial inner periphery of the ledge to the full diameter of the tube, but inboard from the trailing end of the tube. Diametrically opposed wrench receiving flats are cut into the trailing end of the tube extending about ½" from the trailing end at a depth of about ¼".

A ring of circumferentially spaced bores, preferably six in number, starting from the I.D. of the tube, are drilled through the zone between the inner and outer ledges and extending normal to the zone and thus diverging rearwardly and outwardly. These bores are tapered so that the diameters thereof at the outer ledge are less than the diameters at the inner ledge. Preferably the inner ends of the bores are cylindrical. The large diameter inner ends of these bores preferably open into the inner diameter of the tube inwardly from the inner ledge. The bores surround the conical neck portion of the tube in diverging relation therewith. The inner ends of the bores may have a diameter of about 5/16" with the outer ends having a diameter of about ¼".

Hard wear resisting nozzle insert tubes, preferably formed of tungsten carbide, having tapered outer peripheries mating with the tapered portions of the bores are wedged on and preferably cemented to the bores with an epoxy adhesive. These insert tubes are shorter than the bores and have mouths diverging at an 45° angle from their cylindrical I.D.'s which may be less than ⅛" in diameter.

A nose cap is welded to the leading end of the tubular body covering the counterbore. The cap may have various shapes suited for seeking a path through debris in the passage to be cleared. One or more bores may also be provided in the cap to eject a water jet forwardly to clear a path for the nozzle. The outer diameter of the leading edge of the tubular body and the trailing edge of the nose cap are bevelled so that when the cap is bottomed on the body a peripheral V weld bond groove is provided.

It will, of course, be understood that the above mentioned dimensions may vary widely to suit conditions and are only listed as an example of a best mode embodiment of the invention such as shown on the drawings.

ON THE DRAWINGS:

FIG. 1 is a side elevational view, with a portion broken away and shown in longitudinal section of a jet nozzle of this invention.

FIG. 2 a rear end elevational view taken along the line II—II of FIG. 1.

Figure 1:
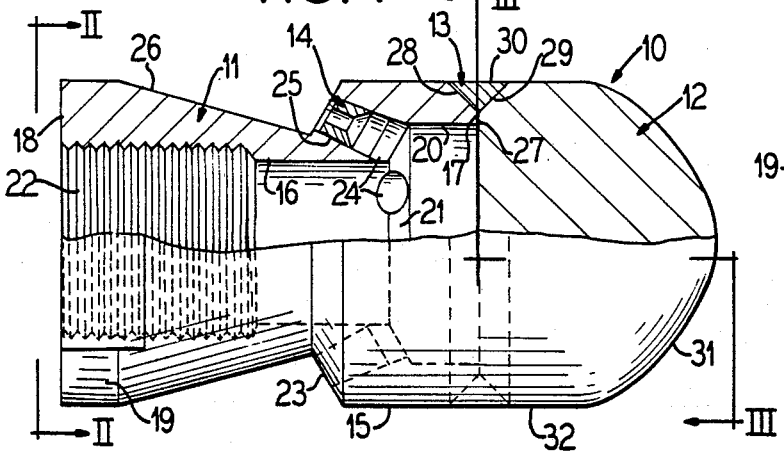
Figure 2:
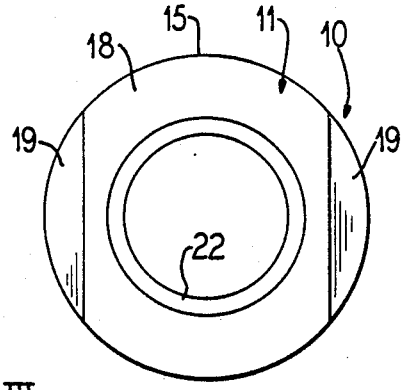
Figure 3:
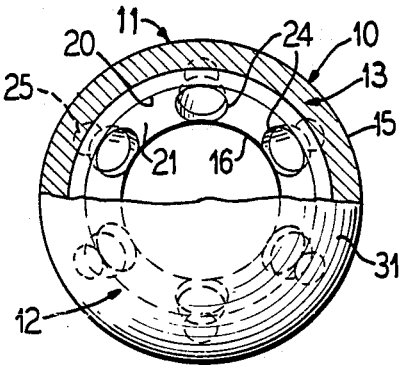
FIG. 3 is a front elevational view, with parts in transverse section taken along the broken line III—III of FIG. 1.

AS SHOWN ON THE DRAWINGS:

The jet nozzle 10 of FIGS. 1–3 is composed of a tubular member 11, a nose cap 12, a weld bond 13 uniting the cap to the leading end of the body and wear resistant jet nozzle tubes 14 anchored in the body.

The body 11 is a thick wall corrosion resistant metal tube having a cylindrical outer diameter 15, a cylindrical inner diameter 16, a radial leading end face or rim 17, a trailing end face 18, and diametrically opposed wrench receiving flats 19 in the periphery of the trailing end. The leading end of the tube is counterbored at 20 inwardly from the leading end face 17 to a shoulder or ledge 21 with slopes inwardly and rearwardly to the internal diameter 16 of the tube. The interior of the tube is threaded at 22 from the trailing end 18 providing a number of threads to unite the tube to a water conduit.

The outer diameter of the tubular body 11 is machined to provide an outer shoulder ledge 23 generally parallel with the ledge 21 that is spaced rearwardly therefrom to provide a substantial gap therebetween through which is drilled a ring of equally spaced circumferential bores 24. These bores diverge outwardly and rearwardly from the counterbore 20 and have tapered outer ends 25 adjacent the ledge 23 receiving the inserts 14.

The outer diameter of the tubular body 11 is machined to form a conical neck portion 26 extending from the radial inner end of the ledge 23 to the full outer diameter 15 of the tube at the trailing end 18.

The nose 12 is solid and has a flat rear face 27 bottomed on the front face 17 of the body 11. The periphery of the face 17 is rearwardly tapered at 28 and the face 27 is forwardly tapered at 29 with the tapers cooperating to form a V groove around the periphery of the leading end of the body and trailing end of the nose which is filled with a weld bond 30 uniting the nose and body.

The nose cap 12 has a fragmental spherical leading end 31 diverging to a cylindrical outer diameter 32 flush with the outer diameter 15 of the body 11.

The jet nozzle 10 of FIGS. 1–3 thus has an internally threaded trailing end portion for receiving a pipe, a hose or the like, to force water under high pressure into the inner diameter 16 of the body 11 from which it flows into the chamber provided by the counterbore 20 which is blocked by the rear end face 27 of the nose cap 12 so that the water can only escape through the bores 24 into the nozzle jet tube inserts 14. The water is ejected from the inserts in rearwardly opening diverging high pressure streams surrounding the conical portion 26 of the body and these jet streams propel the nozzle through a passage while at the same time backwashing debris in the passage.

The flats 19 receive the jaws of a wrench to facilitate threading of the nozzle onto the water conduit.

Figure 4:
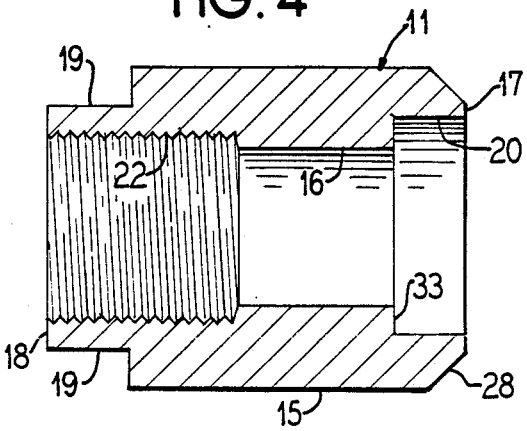
FIG. 4 is a longitudinal sectional view illustrating initial machining steps in forming the body member of the jet nozzle of FIGS. 1–3.

As illustrated in FIG. 4, the counterbore 20 is machined into the leading end 17 of the body member 11 to a flat radial shoulder 33 connecting the counterbore with the inner diameter 16 of the tube. The leading end 17 of the tube is machined to form the taper 28, the trailing end of the tube is internally threaded at 22 with the threads extending from the rear face 18 to the inner diameter 16 and the flats 19 are cut into the outer periphery 15 of the tube at the rear end 18.

Figure 5:
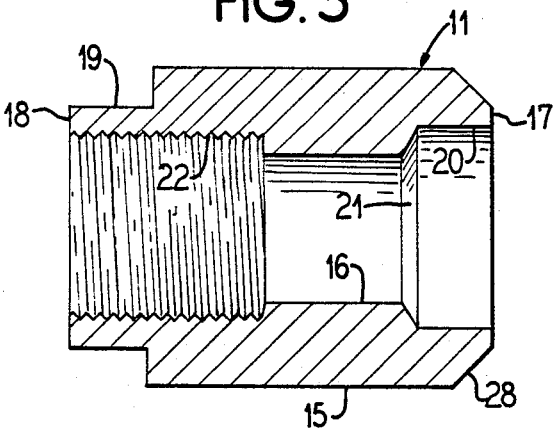
FIGS. 5–7 are views similar to FIG. 4, but illustrating successive machining operations.

In a subsequent machining operation illustrated in FIG. 5, the radial shoulder 33 is machined to form the aforesaid inner ledge 21 sloping rearwardly and radially inward from the counterbore 20 to the inner diameter 16.

Figure 6:
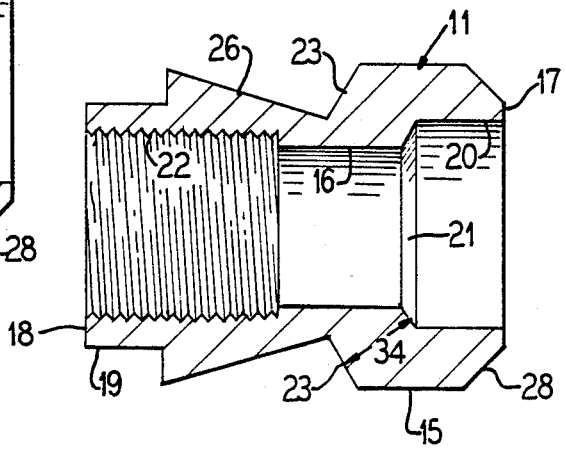

In a further machining operation illustrated in FIG. 6, the outer ledge 23 is cut into the outer periphery 15 of the tube 11 parallel to the inner ledge 21 and spaced a substantial distance therefrom to provide a relatively wide or thick zone 34 therebetween. The outer diameter of the tube 11 is also machined at 26 to form a conical portion between the radial inner end of the ledge 23 and the peripheral portion of the rear end of the tube into which the flats 19 have been cut.

Figure 7:
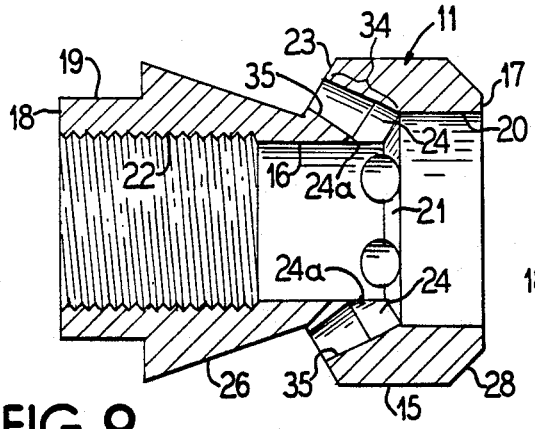

In a still further machining operation illustrated in FIG. 7, the holes 24 are drilled through the zone 34 connecting the ledges 21 and 23. These holes diverge outwardly and rearwardly from the counterbore 20 and their inner ends are cut through the inner diameter 16 as illustrated at **24*a* thereby providing the holes with larger diameters than the width of the tapered ledge 21. These holes 24 have reduced diameter outer ends 35** and the cylindrical inner end portions of the holes converge or taper to the outer end portions whereby the holes have cylindrical inner ends and conical outer ends tapered to the reduced diameter outer ends.

Figure 8:
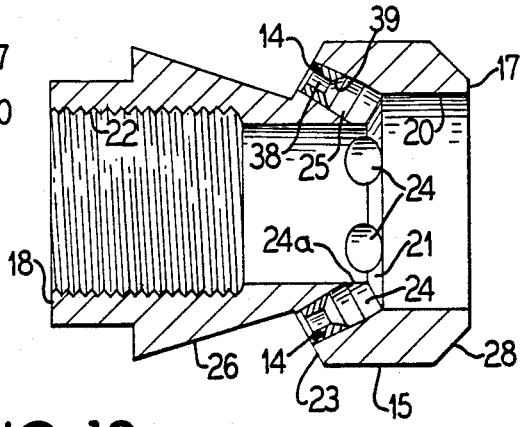
FIG. 8 is a view similar to FIG. 7, but illustrating wear resisting nozzle insert tubes in position in the body member.
Figure 9:
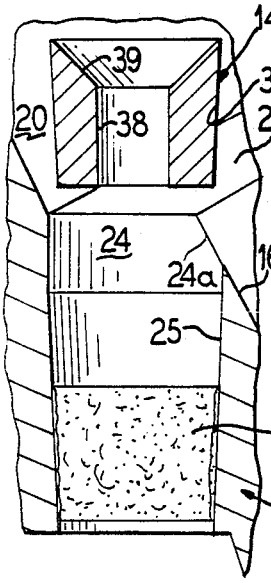
FIG. 9 is an enlarged exploded vertical sectional view illustrating the manner in which the inserts are secured in the bores.

The machined body member 11 of FIG. 7 receives the tubular jet inserts 14, as shown in FIG. 8. As better shown in the enlarged view of FIG. 9, the jet insert tube 14 has a tapered outer periphery 36 mating with the tapered portion 25 of the hole 24 in which it is seated. This tapered outer periphery 36 is cemented in the tapered hole 25 by an epoxy resin 37.

The insert has a cylindrical bore 38 with a tapered inlet mouth 39 diverging from the bore to the hole 24.

It will thus be understood that, in operation of the nozzle 10, the inserts 14 are wedged tightly in the tapered portions 25 of the bore and the high pressured jet streams flowing therethrough cannot eject the inserts from the bores. In addition, of course, the resin cement 37 anchors the inserts 14 in the bores.

The wear resistant insert 14 accommodates the use of relatively large diameter bores 24 for free flow of the high pressure water from the chamber provided by the counterbore 20 into the mouth 29 of the insert where the water flow is accelerated as its path is converged into the reduced diameter tubular passage 38 through the insert.

Since the bores 24 diverge outwardly, the jet streams emerging from the inserts 14 surround the conical portion 26 of the body, but do not impinge thereagainst.

Figure 10:
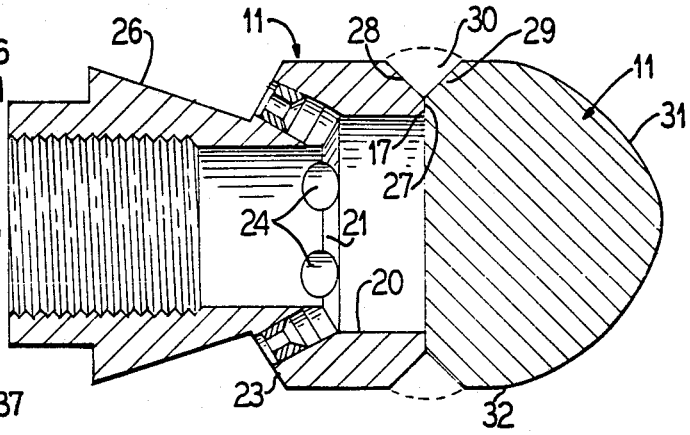
FIG. 10 is a longitudinal sectional view of the machined body member of FIG. 8 with one form of nose cap welded thereon.

As illustrated in FIG. 10, the nose cap 11 is fitted over the finished body 11 with its rear face 27 abutted against the leading face 17 of the body covering the counterbore 20 with the tapered or bevelled faces 28 and 29 confronting each other to provide the groove for the weld bond 30.

Figure 11:
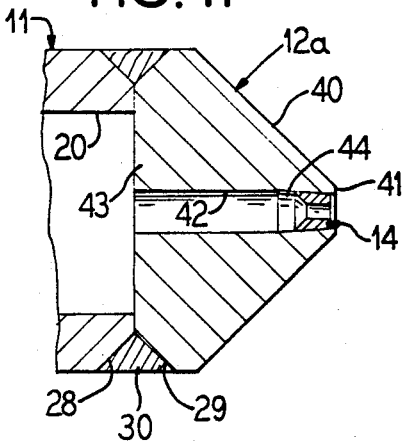
FIG. 11 is a fragmentary view similar to FIG. 10 illustrating a second form of nose cap welded on the body.

As illustrated in FIG. 11, the body 11 may be fitted with a modified nose cap **12*a* which has a conical leading face 40 instead of a spherical face 31. This conical face 40 converges to a flat radial apex 41. A cylindrical bore 42 is drilled axially through the cap 12 from its trailing or base face 43 to the apex 41 and the leading or outer portion of this bore 42 is tapered at 44 to receive and wedge lock an insert 14**. This arrangement provides a forwardly discharging jet stream to wash upstream debris in the passage being cleaned.

Figure 12:
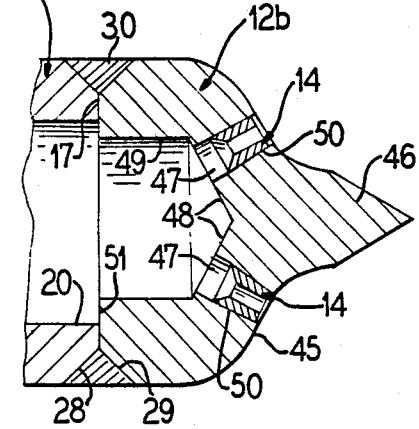
FIG. 12 is a view similar to FIG. 11 illustrating a third form of nose cap welded on the body.

As shown in FIG. 12, a further modified nose cap **12*b* is mounted on the body 11. This end cap has a domed leading face 45 with a central pointed conical spear 46. A pair of cylindrical bores 47 are drilled through the cap diverging radially outwardly and forwardly from an inclined ledge bottom 48 of a counterbore 49 in the back face of the cap. These bores 47 also have tapered front ends 50 wedge fitting inserts 14 therein. The back face 51 of the cap is welded to the front face 17 of the body 11. The counterbore 20 discharges into the counterbore 49 of the cap 12*b* and the bores 47 of the cap transmit water to the inserts 14 for ejecting high pressure water streams forwardly and outwardly around the spear 46**.

From the above description it will therefore be clearly understood that this invention provides improved self-propelled jet nozzles utilizing a machined main body tube and a nose cap to accommodate easy formation of tapered nozzles that wedge lock wear resisting nozzle tubes against blow out by the high pressure water streams created by the nozzle.

I claim as my invention:

1. A self-propelling jet nozzle for attachment to a high pressure water conduit which comprises a tubular body member having means at its trailing end for attachment to the high pressure water conduit and a nose cap covering its leading end, said tube having radially and rearwardly inclined ledge around the interior thereof spaced rearwardly from said nose cap, said tube having an inclined exterior ledge substantially parallel with the inclined inner ledge and spaced rearwardly therefrom, a ring of inclined bores connecting said ledges and tapered along the length thereof to provide inner ends of larger diameter than outer ends, and wear resistant jet nozzle tubes wedged in said bores discharging jet stream rearwardly and outwardly from the tube whereby high pressure water from a conduit attached to the trailing end of the tube flows forwardly through the tube against the nose cap and thence rearwardly through the bores and nozzle tubes to propel the jet nozzle forwardly.

2. The nozzle of claim 1 wherein the nose cap has a forwardly discharging bore.

3. The nozzle of claim 2 wherein the forwardly discharging bore has a wear resisting jet tube secured in the leading end thereof.

4. The nozzle of claim 1 wherein the nose cap has a leading central apex diverging rearwardly to the periphery of the tube.

5. The jet nozzle of claim 1 wherein the nose cap has a plurality of bores diverging radially outwardly and forwardly.

6. The nozzle of claim 5 wherein the nose cap has a central pointed spear between the bores.

7. The nozzle of claim 1 wherein the nose cap has a fragmental spear leading end.

8. The nozzle of claim 1 wherein the nose cap has a frustoconical leading end.

9. A jet nozzle which comprises a tubular body having an internally threaded rear end portion, an enlarged counterbore leading end portion and a front end nose covering the counterbore, said counterbore having an inclined ledge at its inner end, said tubular body member having an inclined exterior ledge rearwardly from said interior ledge and substantially parallel therewith, a ring of circumferentially spaced jet nozzles connecting said inner and outer ledges, and said jet nozzles diverging outwardly from the tubular body at a sufficient angle to clear jet streams issuing therefrom from the body.

10. The jet nozzle of claim 9 wherein the tubular body has diametrically opposed wrench receiving flats in the periphery of the trailing end thereof.

11. The jet nozzle of claim 9 wherein the tubular body has an external conical neck portion extending from the inner end of the external ledge to the full outer diameter of the tube at the trailing end thereof.

12. The jet nozzle of claim 9 wherein the ring of circumferentially spaced nozzles are seated in tapered bores connecting the ledges which converge from the inner to the outer ends thereof.

* * * * *